US007266959B2

(12) United States Patent
Lewis

(10) Patent No.: US 7,266,959 B2
(45) Date of Patent: Sep. 11, 2007

(54) COLD CLIMATE AIR-SOURCE HEAT PUMP

(76) Inventor: Donald Lewis, 4 North Rd., Brewer, ME (US) 04412

( * ) Notice: Subject to any disclaimer, the term of this patent is extended or adjusted under 35 U.S.C. 154(b) by 479 days.

(21) Appl. No.: 11/049,823

(22) Filed: Feb. 3, 2005

(65) Prior Publication Data

US 2006/0168973 A1 Aug. 3, 2006

(51) Int. Cl.
*F25B 7/00* (2006.01)
*F25B 41/00* (2006.01)
*F25B 49/00* (2006.01)
*F25B 1/10* (2006.01)

(52) U.S. Cl. ..... 62/175; 62/196.2; 62/229; 62/510

(58) Field of Classification Search ..... 62/175, 62/210, 228.5, 229, 196.2, 203
See application file for complete search history.

(56) References Cited

U.S. PATENT DOCUMENTS 5,062,274 A * 11/1991 Shaw ..... 62/117
5,839,886 A 11/1998 Shaw
5,927,088 A 7/1999 Shaw
6,276,148 B1 8/2001 Shaw
6,615,602 B2 9/2003 Wilkinson
6,931,871 B2 * 8/2005 Shaw et al. ..... 62/228.5
RE39,625 E * 5/2007 Shaw ..... 62/117
2005/0044866 A1 * 3/2005 Shaw et al. ..... 62/160

* cited by examiner

*Primary Examiner*—Marc Norman
(74) *Attorney, Agent, or Firm*—Anthony D. Pellegrini

(57) ABSTRACT

An improved cold climate air-source heat pump comprising at least a primary compressor, a booster compressor, a first heat exchanger associated with an indoor environment and a second heat exchanger associated with an outdoor environment and with one heat exchanger acting as an evaporator and the other heat exchanger acting as a condenser, an expansion device, flow conduit means for circulating a refrigerant fluid in a closed loop, a first sensor means for sensing the temperature of the internal ambient air, a second sensor means for sensing the temperature of the external ambient air, a third sensor means for sensing the temperature of the refrigerant fluid flowing between the booster compressor and the primary compressor, a fourth sensor means for sensing the operative state of the primary compressor, a primary compressor operation control means responsive to inputs from the first sensor means, and a booster compressor operation control means responsive to inputs from the second, third, and fourth sensor means. The booster compressor operation control means is configured to initiate and shut down operation of the booster compressor based on inputs from the various sensor means, to ensure safe operation of the system and improved durability of the air-source heart pump.

19 Claims, 6 Drawing Sheets

COLD CLIMATE AIR-SOURCE HEAT PUMP

FIELD OF THE INVENTION

The invention relates to environmental climate control devices, namely, air-source heat pumps. Specifically, this invention relates to an improvement on cold weather air-source heat pumps for residential and commercial use wherein the durability and safety of operation of said heat pumps is increased.

BACKGROUND OF THE INVENTION

Air-source heat pumps are well known in the art. See, e.g., U.S. Pat. No. 6,615,602 (Wilkinson), which describes a typical air-source heat pump in detail. Air-source heat pumps incorporate a combination of compressors and condensers in a closed-loop system to draw heat energy from the outside air for use in heating interior spaces. They can also be used in reverse to provide for air conditioning of interior spaces. Air-source heat pumps rely on well-known principles of thermodynamics to extract energy from a given volume of air. The maximum energy that can be extracted from a given volume of air by an air-source heat pump is its heating capacity. The heating capacity of an air-source heat pump changes with the temperature of the air from which energy is extracted.

A typical air-source heat pump is arranged with a "high side" and a "low side" configuration, wherein the system refrigerant is at a relatively high pressure and high temperature on the high side and is at a relatively low pressure and low temperature on the low side. Relatively low pressure/low temperature gaseous refrigerant from the low side is introduced into a compressor, which compresses the refrigerant into a high pressure/high temperature gas (compressing a given volume of gas into a smaller volume of gas causes its pressure and temperature to increase). The compressed high pressure/high temperature gas is then forced through a condenser which is in contact with the interior space to be heated; the gas gives up some of its energy in the condenser, thus providing heat to the interior space, and the refrigerant becomes liquefied. The liquid refrigerant is then forced through an expansion device which vaporizes the liquid into a low pressure/low temperature gas. Once the refrigerant has been vaporized into a low pressure/low temperature gas, it is passed through an evaporator which is in contact with the outside air. Heat energy is drawn from the outside air by the refrigerant, which is then introduced to the compressor, repeating the cycle. The portion of the heat pump system between the compressor and the expansion device is the system high side, and the portion of the system from the evaporator back to the compressor is the system low side.

The foregoing is a simplified explanation of the mechanics of how an air-source heat pump works. However, it is sufficient to illustrate a phenomenon of thermodynamics which renders the typical air-source heat pump inefficient in cold climates. As the temperature of the outside air decreases, the expansion device pressurizes less of the refrigerant, resulting in the refrigerant having a lower density (and pressure) for a given volume to achieve a lower boiling point (since the boiling point of the refrigerant must be lower than the temperature of the ambient outside air). As the mass density of the refrigerant decreases eventually the flow of refrigerant will be below the operating capacity of the heat pump. Because air-source heat pumps are designed to handle a specific volume of flow, lowering the amount available lowers the overall heating capacity of the heat pump, because the system high side requires the refrigerant to be of a certain minimum pressure; when the refrigerant pressure is diminished due to decreasing outside air temperatures the compressor must raise the pressure of the refrigerant a greater degree. When the outside temperature becomes cold enough the corresponding pressure differential between the system low side and the system high side becomes too great for the compressor to overcome. To compensate, either compressors with far greater maximum capacity must be used, at great expense and inefficiency, or alternative heat sources must be available when the outside temperature falls too low. Neither of these solutions are practical and thus the use of typical air-source heat pumps is very limited in colder climates, where the need for heat is greatest during those winter months when the outside air is coldest and the resulting heating capacity is lowest.

A solution to the problem of cold climate air-source heat pumps was demonstrated by Shaw in U.S. Pat. No. 5,927,088. Shaw proposed adding a booster compressor in series with and in advance of the primary compressor. The booster compressor is designed to have a greater capacity than the primary compressor, so it can accept lower temperature refrigerant than the primary compressor. The booster compressor also does not need to raise the pressure of the refrigerant to that required of the system high side, but only needs to raise the refrigerant pressure enough to meet the minimum intake pressure requirements of the primary compressor. The use of a booster compressor upstream of the primary compressor thus enables the heat pump to work when cold outside temperatures would reduce the heating capacity of the heat pump to ineffective levels if the primary compressor alone were to be used. As further described by Shaw, the booster compressor would be activated only when the outside air temperature falls below a certain level. When the outside air temperature is sufficiently high, i.e., above the pre-determined activation limit, the booster compressor is bypassed, thus saving the costs of its operation and improving the efficiency of the system as a whole. A system without a booster compressor and having instead a very large capacity primary compressor to accommodate low outside temperatures would have tremendous excess capacity at milder temperatures and thus be quite inefficient to operate.

A known downside to using air-source heat pumps in cold climates is the potential for moisture to freeze onto the evaporator. As ice and frost accumulate onto the evaporator's coils, the transfer of heat becomes less efficient, degrading the entire system's performance. A known solution to this problem is to periodically reverse the flow of refrigerant within the system (as is done when the heat pump is used to cool the interior space), thereby sending heated refrigerant through the evaporator, which then discharges rather than absorbs heat energy, thus defrosting the coils. After allowing the coils to defrost, the flow is restored to permit the refrigerant to absorb heat energy from the outside air. Alternatively, the evaporator coils may be defrosted by the application of heat from an auxiliary heat source, such as an electric heater or a natural gas burner for a predetermined period of time to defrost the coils.

However, these defrost solutions introduce a new problem into the system, namely the potential for the system low side refrigerant to have an initial excess temperature either during or immediately following the defrost cycle. The system low side refrigerant is input into the compressor, as described above; the compressor in turn further increases the temperature of the refrigerant. If the input temperature is initially elevated, the temperature of the refrigerant as it is being compressed may be higher than the limits of the compressor, leading to overheating and potentially damage to or outright failure of the compressor. Where a series of compressors is used, as described by Shaw, the problem is magnified, since the temperature of the refrigerant, elevated as a result of the defrost cycle, is further increased by the booster compressor before the refrigerant is input into the primary compressor.

Another downside to the Shaw design is that the operation of the booster compressor is controlled by the outside air temperature. Thus, when the outside air temperature falls below a predetermined level, the booster compressor is activated. However, it is possible that while the booster compressor is operating the primary compressor may not be operating. This may be for any number of reasons, such as due to an open safety switch, a problem in the control circuitry, power fluctuations, or the like. If the booster were to operate with the primary compressor non-operational, the booster compressor may become damaged and fail. This is because with the primary compressor inoperative the refrigerant will cease to flow through the system. The flow of the refrigerant is used to cool the booster compressor motor and also to circulate oil to lubricate the system (small amounts of oil are carried by the refrigerant). In such circumstances, the booster compressor motor may overheat due to lack of cooling, and may also be damaged due to lack of lubrication. Finally, the accumulated excess refrigerant and oil in the primary compressor reservoir may damage the primary compressor when it becomes operational.

It is an object of this invention to provide a cold climate air-source heat pump which incorporates the efficiencies of the booster compressor design while protecting the overall system from damage from overheating or component shutdown.

It is a further object of this invention to provide a cold climate air-source heat pump which incorporates environmental sensors to detect operating conditions and controllers to initiate and shut down operation of the booster compressor based on inputs from the environmental sensors.

It is a further object of this invention to provide a cold climate air-source heat pump which incorporates an improved defrost means for removing ice from the evaporator coils of the outside evaporator.

Other objects of this invention will be apparent to those skilled in the art from the description and claims which follow.

SUMMARY OF THE INVENTION

The present invention provides for an air-source heat pump comprising at least a primary compressor having a primary compressor inlet and a primary compressor outlet, a booster compressor having a booster compressor inlet and a booster compressor outlet, a first heat exchanger and a second heat exchanger, with one heat exchanger associated with an indoor environment and the other heat exchanger associated with an outdoor environment, and with one heat exchanger acting as an evaporator and the other heat exchanger acting as a condenser, an expansion device, flow conduit means for circulating a refrigerant fluid in a closed loop, a first sensor means for sensing the temperature of the internal ambient air, a second sensor means for sensing the temperature of the external ambient air, a third sensor means for sensing the temperature of the refrigerant fluid flowing between the booster compressor outlet and the primary compressor inlet, a fourth sensor means for sensing the operative state of the primary compressor, a primary compressor operation control means responsive to inputs from the first sensor means, and a booster compressor operation control means responsive to inputs from the second, third, and fourth sensor means. The primary compressor outlet, the first heat exchanger, the expansion device, the second heat exchanger, the booster compressor inlet, the booster compressor outlet, and the primary compressor inlet are placed in respective serial fluid communication to circulate the refrigerant fluid through the air-source heat pump. The primary compressor operation control means is configured to initiate and shut down operation of the primary compressor, depending on the temperature of the internal ambient air as indicated by the first sensor means. The booster compressor operation control means is configured to initiate and shut down operation of the booster compressor, depending on the temperature of the external ambient air, the temperature of the refrigerant fluid flowing between the booster compressor outlet and the primary compressor inlet, and the operative state of the primary compressor, as indicated by the second, third, and fourth sensor means, respectively.

The invention may include as part of the booster compressor operation control means a logic controller. The logic controller evaluates inputs from the second, third, and fourth sensor means to determine when operation of the booster compressor should be initiated and when operation of the booster compressor should be shut down. The invention may also include as part of the booster compressor operation control means a first timing means. The first timing means is activated upon the booster compressor operation control means shutting down operation of the booster compressor as a result of inputs from the third sensor means. Until a predetermined period of time elapses as determined by the first timing means, the operation of the booster compressor cannot be re-initiated. This provides the refrigerant fluid time to cool to operational temperatures.

The invention may be provided with a reversing valve allowing the air-source heat pump to operate in a cooling mode as well as in a heating mode, as is well known in the art. In this configuration the cooling mode may be used to initiate a defrost cycle of the evaporator coils of the second heat exchanger. Other means of initiating a defrost cycle may also be used, such as heating the evaporator coils with external heat sources. When a defrosting cycle is used, the temperature of the refrigerant fluid may be increased to potentially unsafe levels. The invention therefore may include a timing delay in the defrost cycle to allow the refrigerant fluid to cool to safe levels.

Other features and advantages of the invention are described below.

DETAILED DESCRIPTION OF THE INVENTION

Figure 1:
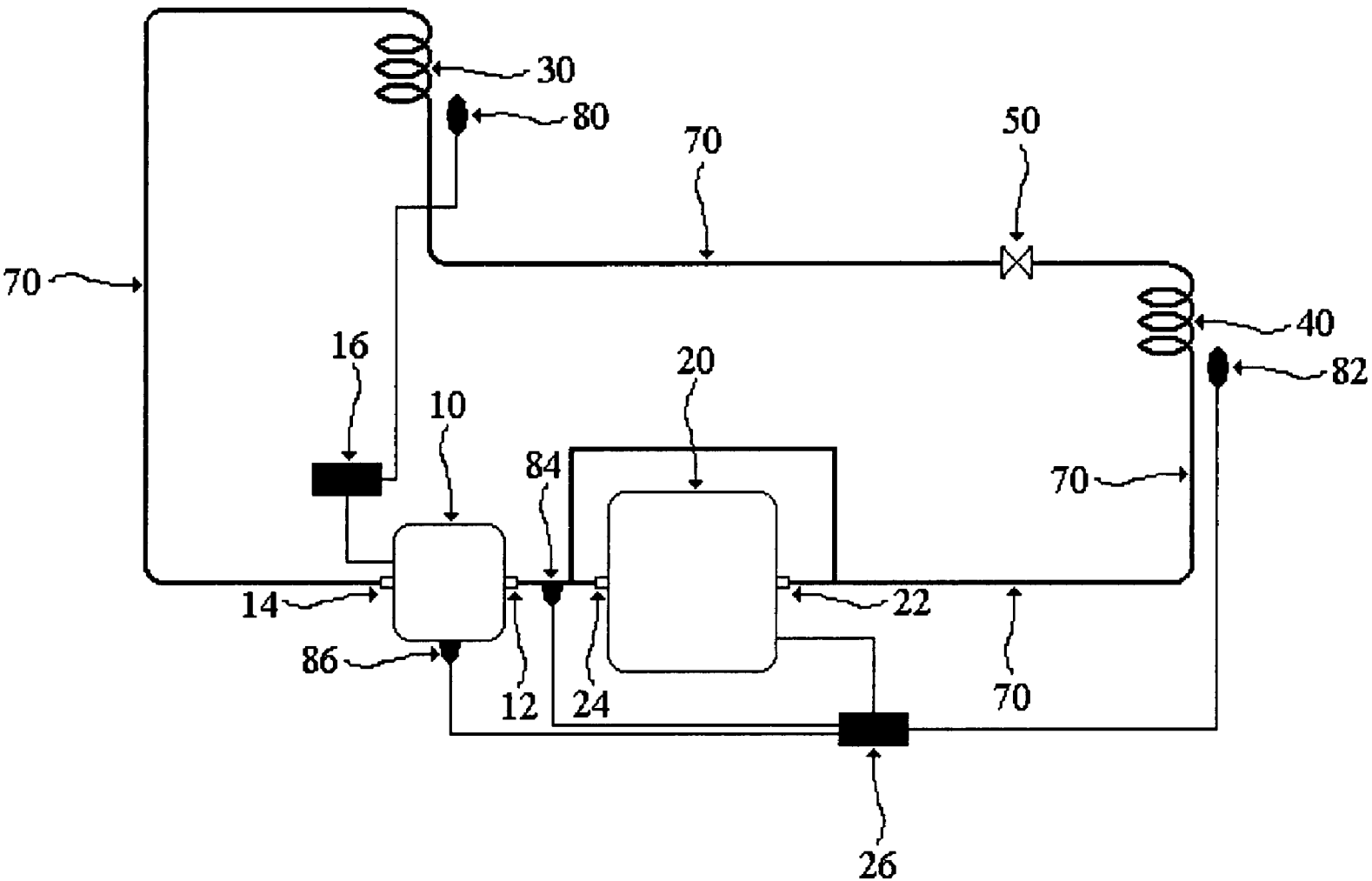
FIG. 1 is a schematic depiction of the air-source heat pump configured for heating mode.

The present invention is an improvement on known air-source heat pumps using a booster compressor along with a primary compressor for efficient operation in cold weather climates. The basic components of the invention are depicted in FIG. 1, a schematic drawing of the interrelationship of those components. These include a primary compressor 10, a booster compressor 20, a first heat exchanger 30, a second heat exchanger 40, an expansion device 50, flow conduit means 70, a first sensor means 80 for sensing the temperature of the internal ambient air, a second sensor means 82 for sensing the temperature of the external ambient air, a third sensor means 84 for sensing the temperature of refrigerant fluid flowing between the booster compressor 20 and the primary compressor 10, a fourth sensor means 86 for sensing the operative state of the primary compressor 10, a primary compressor operation control means 16 responsive to inputs from the first sensor means 80, and a booster compressor operation control means 26 responsive to inputs from the second, third, and fourth sensor means 82,84,86. The refrigerant fluid used is R410A, a high pressure, high efficiency refrigerant. Use of R410A improves the efficiency of the system as a whole because it has a smaller compression ratio, resulting in less required work for the compressors. It also has a better thermal transfer efficiency and is non-ozone depleting. However, other types of refrigerant fluids may also be used. The flow conduit means 70 is typically copper tubing, though other types of tubing may be used. The preferred expansion device 50 is a thermal expansion valve.

The primary compressor 10 has a primary compressor inlet 12 and a primary compressor outlet 14. Refrigerant fluid in a gaseous state and at a relatively low temperature and pressure enters the primary compressor 10 from the flow conduit means 70 through the primary compressor inlet 12. The primary compressor 10 compresses the refrigerant fluid until it achieves a relatively higher temperature and pressure, whereupon it exits the primary compressor 10 through the primary compressor outlet 14 into the flow conduit means 70. The temperature of the refrigerant fluid entering the primary compressor 10 is typically within the range 70° F. to 80° F. The pressure of the refrigerant fluid entering the primary compressor 10 is typically within the range 130 to 140 psi. These ranges represent the typical operational temperature and pressure ranges of the primary compressor 10. The temperature of the refrigerant fluid exiting the primary compressor 10 is typically within the range 120° F. to 150° F. The pressure of the refrigerant fluid exiting the primary compressor 10 is typically within the range 350 to 500 psi. These ranges represent the typical operational temperature and pressure ranges of the heating system.

When the temperature of the external ambient air is below a certain point, the temperature and pressure of the refrigerant fluid prior to entering the primary compressor 10 will be below the operational range of the primary compressor 10. When this occurs, the primary compressor 10 will not be able to efficiently raise the temperature and pressure of the refrigerant fluid to the operational range of the heating system. The present invention therefore makes use of a booster compressor 20 which is located upstream from the primary compressor 10. The booster compressor 20 has a booster compressor inlet 22 and a booster compressor outlet 24. Refrigerant fluid enters the booster compressor 20 from the flow conduit means 70 through the booster compressor inlet 22. The booster compressor 20 compresses the refrigerant fluid until it achieves a relatively higher temperature and pressure when it exits the booster compressor 20 through the booster compressor outlet 24 into the flow conduit means 70. The temperature and pressure of the refrigerant fluid exiting the primary compressor 10 is within the operational range for the primary compressor 10. The booster compressor 20 is efficient because it need not raise the temperature and pressure of the refrigerant fluid all the way to the operational range of the heating system, but only to the operational range of the primary compressor 10. Moreover, the booster compressor 20 is typically of larger capacity than the primary compressor 10, so that it can raise very low temperatures and pressures of the refrigerant fluid to the operational range of the primary compressor 10. In the preferred embodiment, the booster compressor 20 has a displacement capacity of 170% of the displacement capacity of the primary compressor 10. The efficiency is realized by not having to run the booster compressor 20 when the external ambient air temperature is warmer.

Pressurized gaseous refrigerant fluid is propelled out of the primary compressor outlet 14 through the flow conduit means 70 to the first heat exchanger 30. While in heating mode, the first heat exchanger 30 acts as a condenser 32. The high temperature, high pressure refrigerant fluid passes through the condenser coils of the first heat exchanger 30, giving off heat energy to heat the ambient air of the interior space. Fans may be employed to increase circulation of ambient air over the condenser coils. The refrigerant fluid, having been condensed to a liquid in the condenser 32, continues along the flow conduit means 70 to the expansion device 50, which causes the liquid refrigerant fluid to be expanded into a low temperature, low pressure gas. The low temperature, low pressure refrigerant fluid is propelled through the flow conduit means 70 to the second heat exchanger 40, which in heating mode acts as an evaporator 42. The low temperature, low pressure refrigerant fluid passes through the evaporator coils of the second heat exchanger 40, absorbing heat energy from the exterior ambient air. Finally, the low temperature, low pressure refrigerant fluid passes through the flow conduit means 70 to either the booster compressor inlet 22, if the ambient external air temperature is cold enough, or directly to the primary compressor inlet 12 if the ambient external air temperature is warm enough.

The present invention comprises several sensing means for determining the environmental and operation state of the air-source heat pump. A first sensor means 80 is used for sensing the temperature of the internal ambient air. The temperature of the internal ambient air is used to determine whether the air-source heat pump should be operating or not. In the preferred embodiment the first sensor means 80 is an electronic temperature sensing device. However, other sensing means known in the art may also be used.

A second sensor means 82 is used for sensing the temperature of the external ambient air. The temperature of the external ambient air is used to determine whether the booster compressor 20 should be operating or not. In the preferred embodiment the second sensor means 82 is an electronic temperature sensing device. However, other sensing means known in the art may also be used.

A third sensor means 84 is used for sensing the temperature of the refrigerant fluid flowing through the flow conduit means 70 between the booster compressor outlet 24 and the primary compressor inlet 12. The temperature of the refrigerant fluid flowing through the flow conduit means 70 between the booster compressor outlet 24 and the primary compressor inlet 12 is used to determine whether the booster compressor 20 should be operating or not. In the preferred embodiment the third sensor means 84 is an electronic temperature sensing device. However, other sensing means known in the art may also be used.

A fourth sensor means 86 is used for sensing the operative state of the primary compressor 10. The operative state of the primary compressor 10 is used to determine whether the booster compressor 20 should be operating or not. In one embodiment, the fourth sensor means 86 comprises a current transformer which reads the current flowing to the primary compressor 10. The current transformer may be set to recognize a predetermined range, indicating the primary compressor 10 is operating. When current flowing to the primary compressor 10 falls outside the predetermined range the primary compressor 10 is deemed to be inoperative. In another embodiment, the fourth sensor means 86 comprises a centrifugal switch, which signals that the primary compressor 10 is operative when the primary compressor motor is turning. In yet another embodiment, the fourth sensor means 86 comprises a flow switch, which signals that the primary compressor 10 is operative when the measured flow of the refrigerant fluid from the primary compressor outlet 14 falls within a predetermined range.

The addition of a means for determining whether the primary compressor 10 is operating or not is an important safety feature of the present invention and an improvement over the prior art. The primary compressor 10 may be inoperative for any number of reasons, such as an open safety switch, a problem in its control circuitry, power fluctuations, etc. If the booster compressor 20 were to operate while the primary compressor 10 is inoperative, the booster compressor 20 would eventually fail. With the primary compressor 10 inoperative the refrigerant fluid will cease to flow through the system. Because the flow of the refrigerant fluid is used to cool the booster compressor motor and also to circulate oil to lubricate the system, in such circumstances the booster compressor motor may overheat due to lack of cooling, and may also be damaged due to lack of lubrication. Moreover, the primary compressor 10 itself may be damaged if the booster compressor 20 is permitted to operate while the primary compressor 10 is inoperative. Refrigerant fluid and oil from the system will be forced into the reservoir of the primary compressor 10 by the booster compressor 20, but because the primary compressor 10 is inoperative the refrigerant fluid and oil will not circulate and will build up to excess levels. When the primary compressor 10 is eventually activated the excess amount of refrigerant fluid and oil in the reservoir may damage the primary compressor 10. In limiting the operation of the booster compressor 20 only to those times when the primary compressor 10 is operating, the present invention improves the durability of the system as a whole and increases its useful life.

The various sensor means are in connection with compressor operation control means. Associated with the primary compressor 10 is a primary compressor operation control means 16. The primary compressor operation control means 16 is in connection with the primary compressor 10 and in connection with the first sensor means 80. The primary compressor operation control means 16 is responsive to inputs from the first sensor means 80, and is configured to initiate and shut down operation of the primary compressor 10, depending on the temperature of the internal ambient air as indicated by the first sensor means 80. In the preferred embodiment, the primary compressor operation control means 16 initiates operation of the primary compressor 10 when the temperature of the internal ambient air as indicated by the first sensor means 80 falls below a first predetermined level, and the primary compressor operation control means 16 shuts down operation of the primary compressor 10 when the temperature of the internal ambient air as indicated by the first sensor means 80 exceeds a second predetermined level. The second predetermined level of temperature of the internal ambient air may be set at a level higher than the first predetermined level, to avoid the inefficiency and wear and tear on the system of repeated initiation/shut down cycling of the primary compressor 10 when the temperature of the internal ambient air is right about the first predetermined level.

Associated with the booster compressor 20 is a booster compressor operation control means 26. The booster compressor operation control means 26 is in connection with the booster compressor 20 and in connection with the second, third, and fourth sensor means 82,84,86. The booster compressor operation control means 26 is responsive to inputs from the second, third, and fourth sensor means 82,84,86, and is configured to initiate and shut down operation of the booster compressor 20, depending on those inputs. Specifically, the booster compressor operation control means 26 is configured to initiate and shut down operation of the booster compressor 20 depending on the temperature of the external ambient air, the temperature of the refrigerant fluid flowing between the booster compressor outlet 24 and the primary compressor inlet 12, and the operative state of the primary compressor 10.

In the preferred embodiment of the invention, the booster compressor operation control means 26 comprises a logic controller. The logic controller evaluates inputs from the second, third, and fourth sensor means 82,84,86 to determine when operation of the booster compressor 20 should be initiated and when operation of the booster compressor 20 should be shut down. Operation of the booster compressor 20 is initiated when all of the following conditions are met: the second sensor means 82 indicates the temperature of the external ambient air is below a third predetermined level, the third sensor means 84 indicates the temperature of the refrigerant fluid flowing between the booster compressor outlet 24 and the primary compressor inlet 12 does not exceed a fifth predetermined level, and the fourth sensor means 86 indicates the primary compressor 10 is operative. Operation of the booster compressor 20 is shut down when any of the following conditions is met: the second sensor means 82 indicates the temperature of the external ambient air has achieved a fourth predetermined level and/or the third sensor means 84 indicates the temperature of the refrigerant fluid flowing between the booster compressor outlet 24 and the primary compressor inlet 12 exceeds a fifth predetermined level and/or the fourth sensor means 86 indicates the primary compressor 10 is inoperative. The third predetermined level of temperature of the external ambient air is set at a level where the heating capacity of the external ambient air is insufficient for the primary compressor 10 to operate efficiently. The fourth predetermined level of temperature of the external ambient air may be set at a level higher than the third predetermined level, to avoid the inefficiency and wear and tear on the system of repeated initiation/shut down cycling of the booster compressor 20 when the temperature of the external ambient air is right about the third predetermined level.

In another embodiment, the booster compressor operation control means 26 further comprises a first timing means along with the logic controller. The first timing means is activated upon the booster compressor operation control means 26 shutting down operation of the booster compressor 20 as a result of the third sensor means 84 indicating the temperature of the refrigerant fluid flowing between the booster compressor outlet 24 and the primary compressor inlet 12 exceeds a fifth predetermined level. Thereafter, the logic controller evaluates the first timing means and the inputs from the second, third, and fourth sensor means 82,84,86, and causes the booster compressor operation control means 26 to re-initiate operation of the booster compressor 20 when inputs received by the booster compressor operation control means 26 from the second, third, and fourth sensor means 82,84,86 are determined by the logic controller to indicate proper conditions for operation of the booster compressor 20 and a predetermined period of time has elapsed as determined by the first timing means. This delay gives the refrigerant fluid time to cool to a temperature below the fifth predetermined level so as to avoid overheating the primary compressor 10.

The addition of a means for controlling operation of the booster compressor 20 based on the temperature of the refrigerant fluid flowing between the booster compressor outlet 24 and the primary compressor inlet 12 is another important safety feature of the present invention and an improvement over the prior art. If operation of the booster compressor 20 is initiated under unusual conditions, the temperature of the refrigerant fluid discharged from the booster compressor 20 may be above the operational range of the primary compressor 10. This could cause the primary compressor 10 to overheat, and over time become damaged. Under such circumstances, the logic controller will prevent operation of the booster compressor 20 for a period of time, which will allow the refrigerant fluid to be cooled by the ordinary operation of the primary compressor 10.

Figure 2:
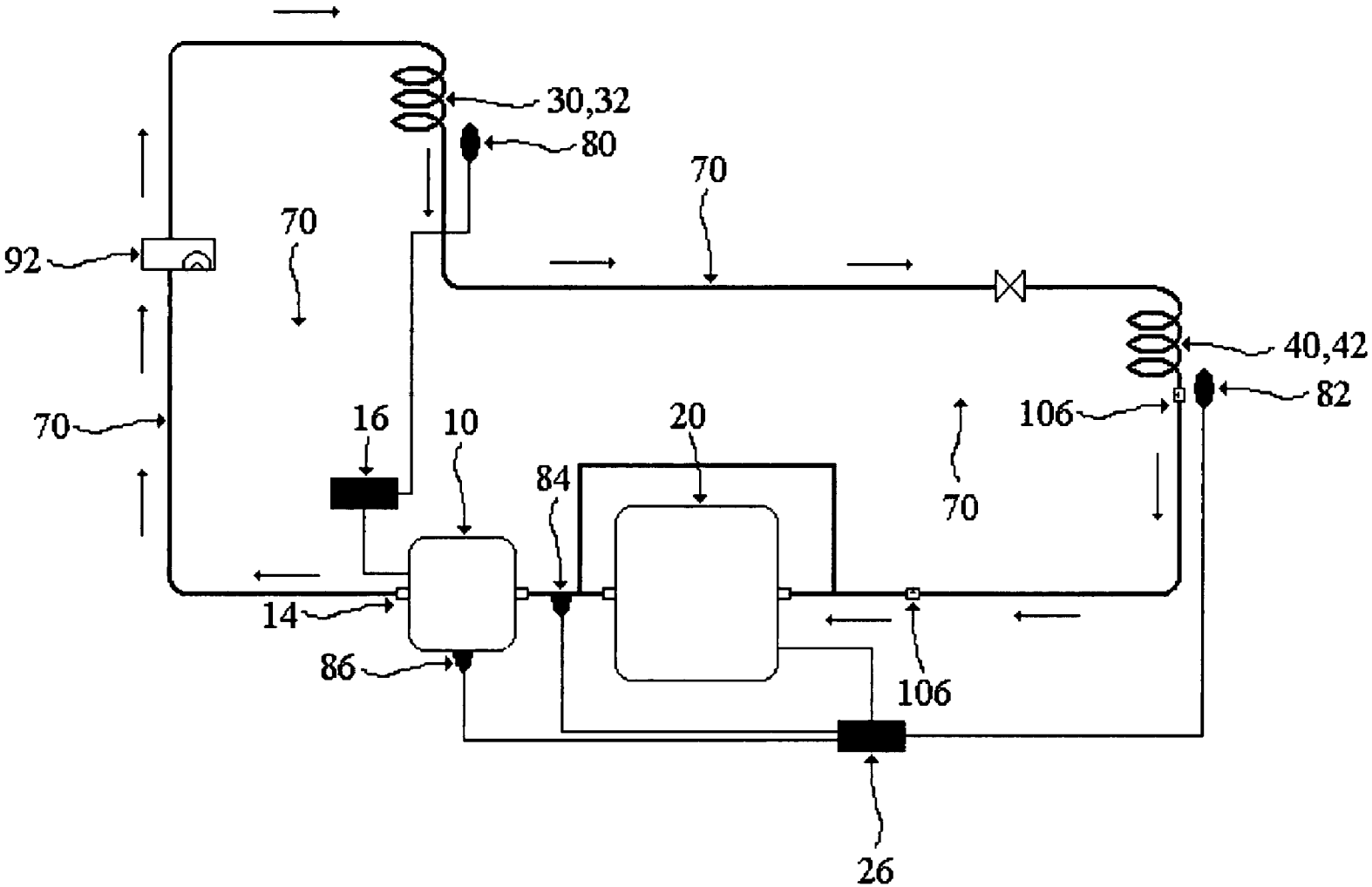
FIG. 2 is a schematic depiction of the air-source heat pump utilizing a reversing valve and configured for heating mode. Directional arrows are included along the flow conduit means to indicate the direction of flow of the refrigerant fluid.
Figure 3:
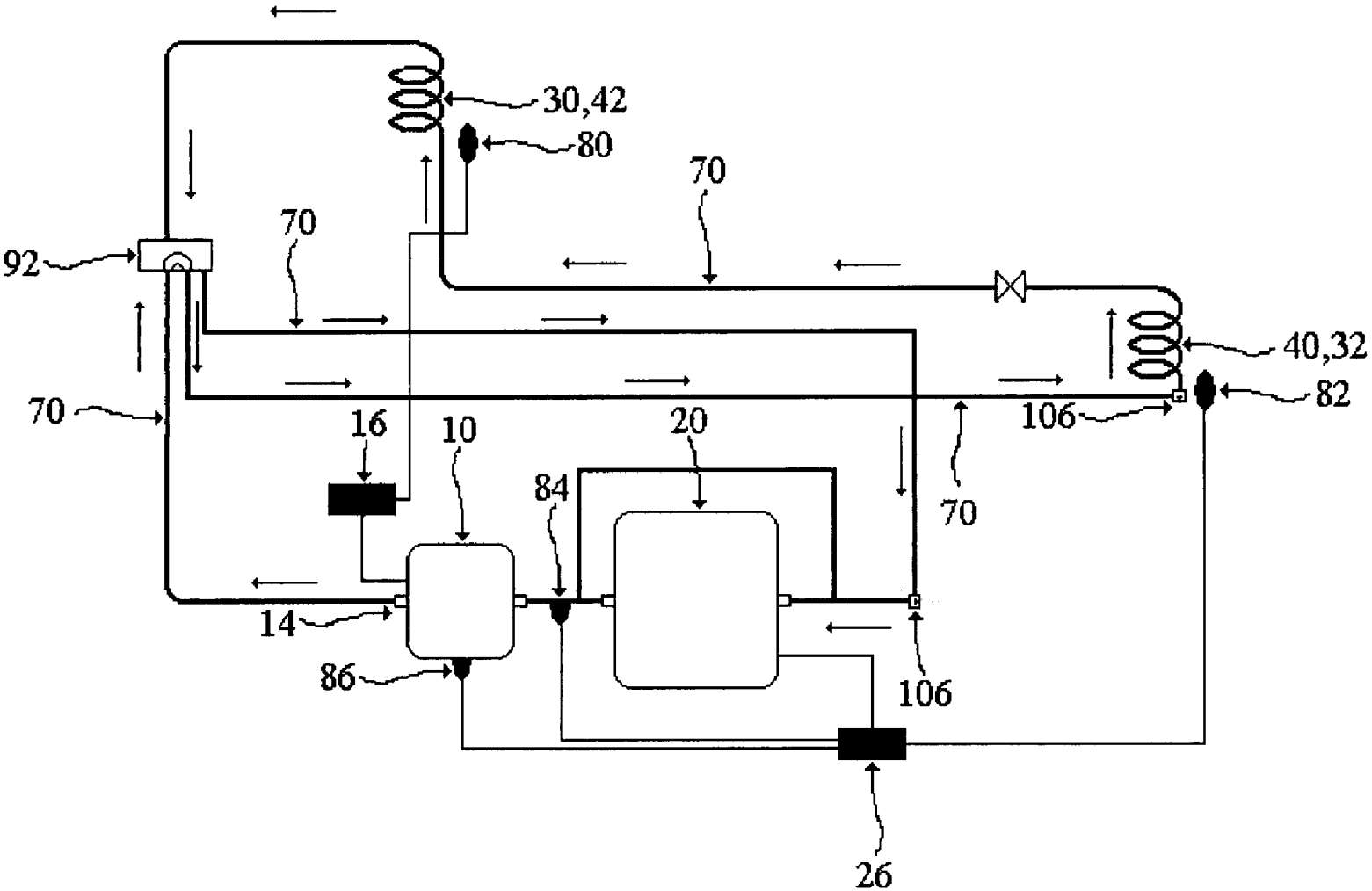
FIG. 3 is a schematic depiction of the air-source heat pump utilizing a reversing valve and configured for cooling mode. Directional arrows are included along the flow conduit means to indicate the direction of flow of the refrigerant fluid.
Figure 4:
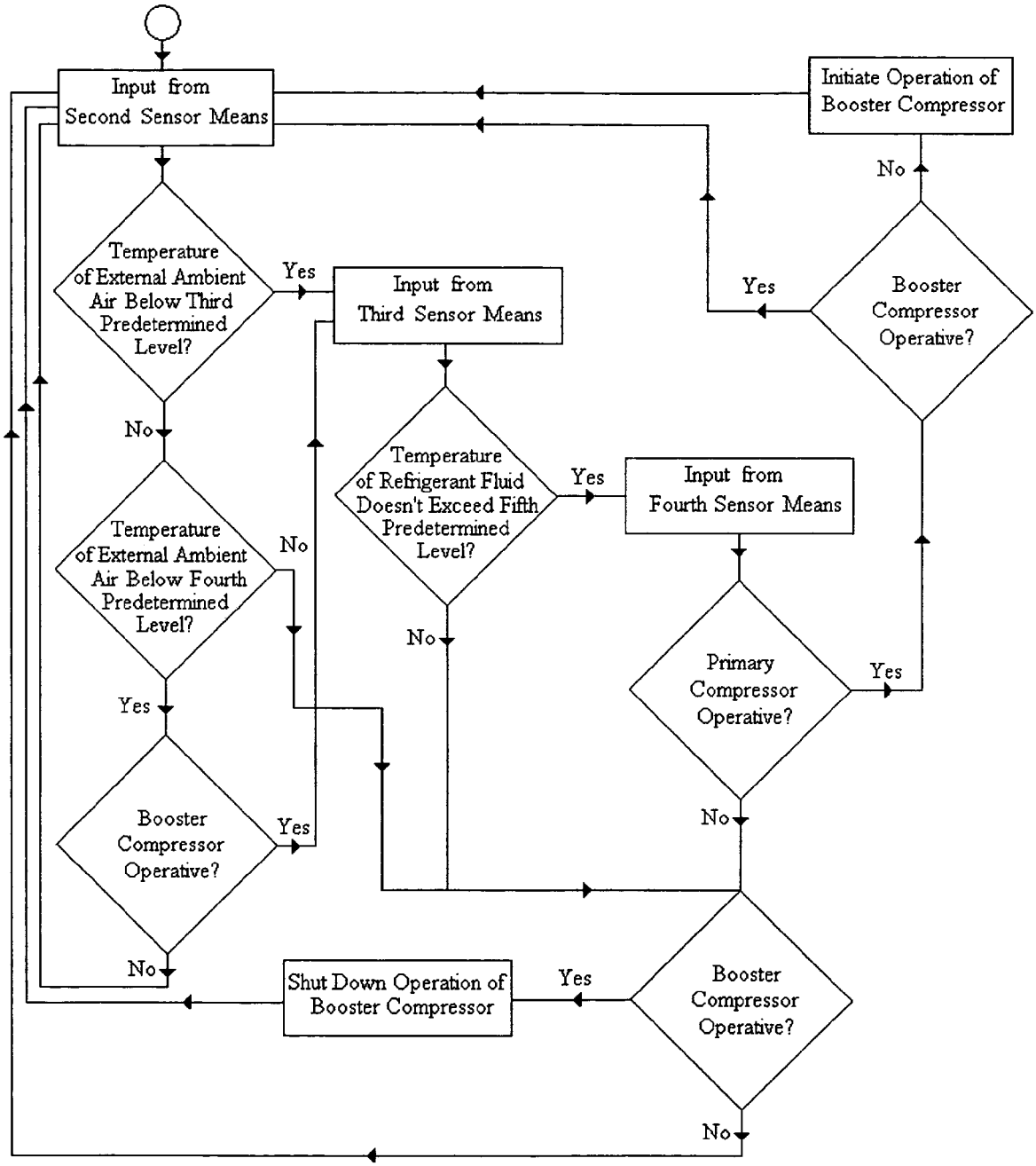
FIG. 4 is a flow chart demonstrating the operation of the logic controller.
Figure 5:
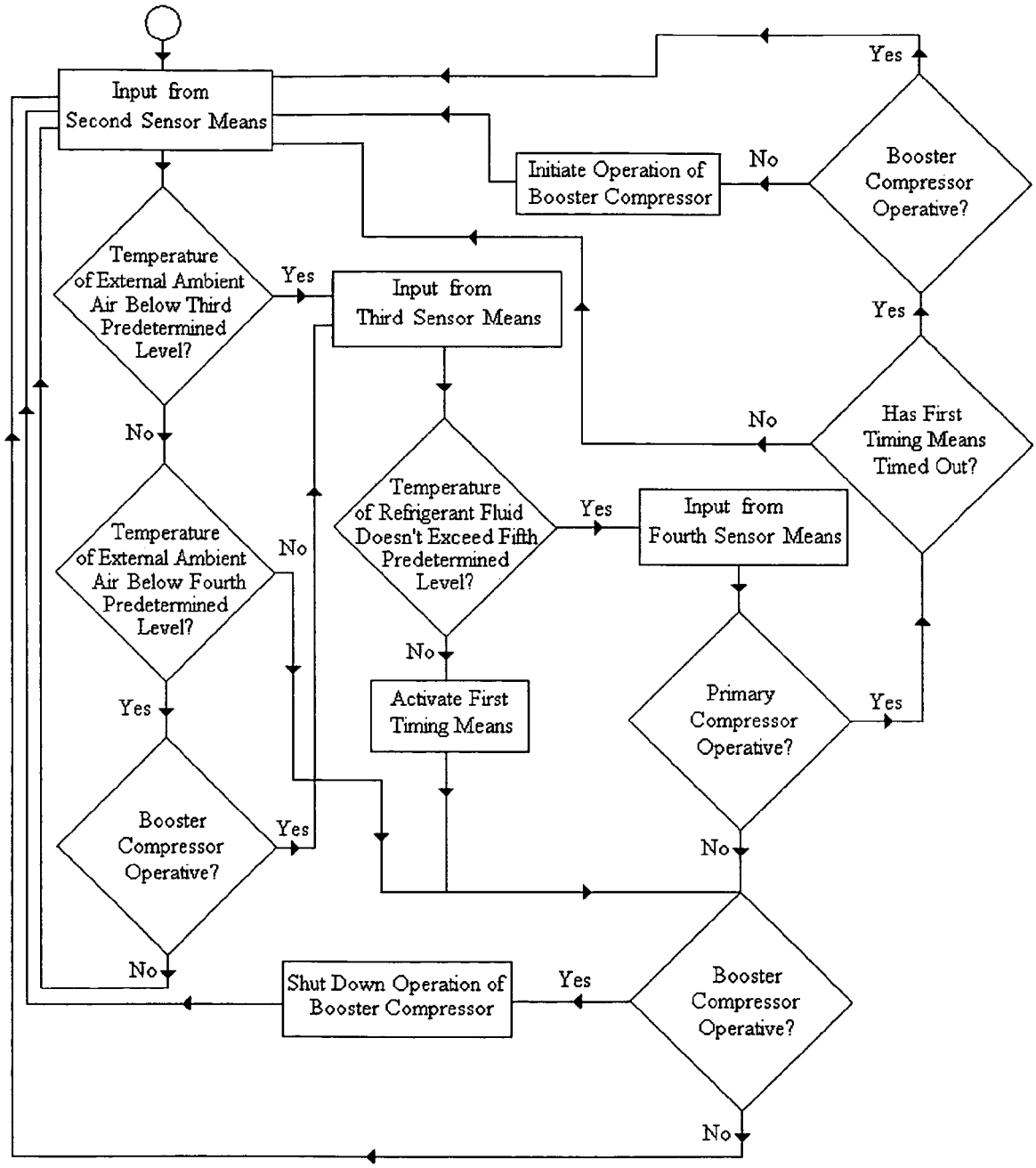
FIG. 5 is a flow chart demonstrating the operation of the logic controller with an optional first timing means used in conjunction with the third sensor means.
Figure 6:
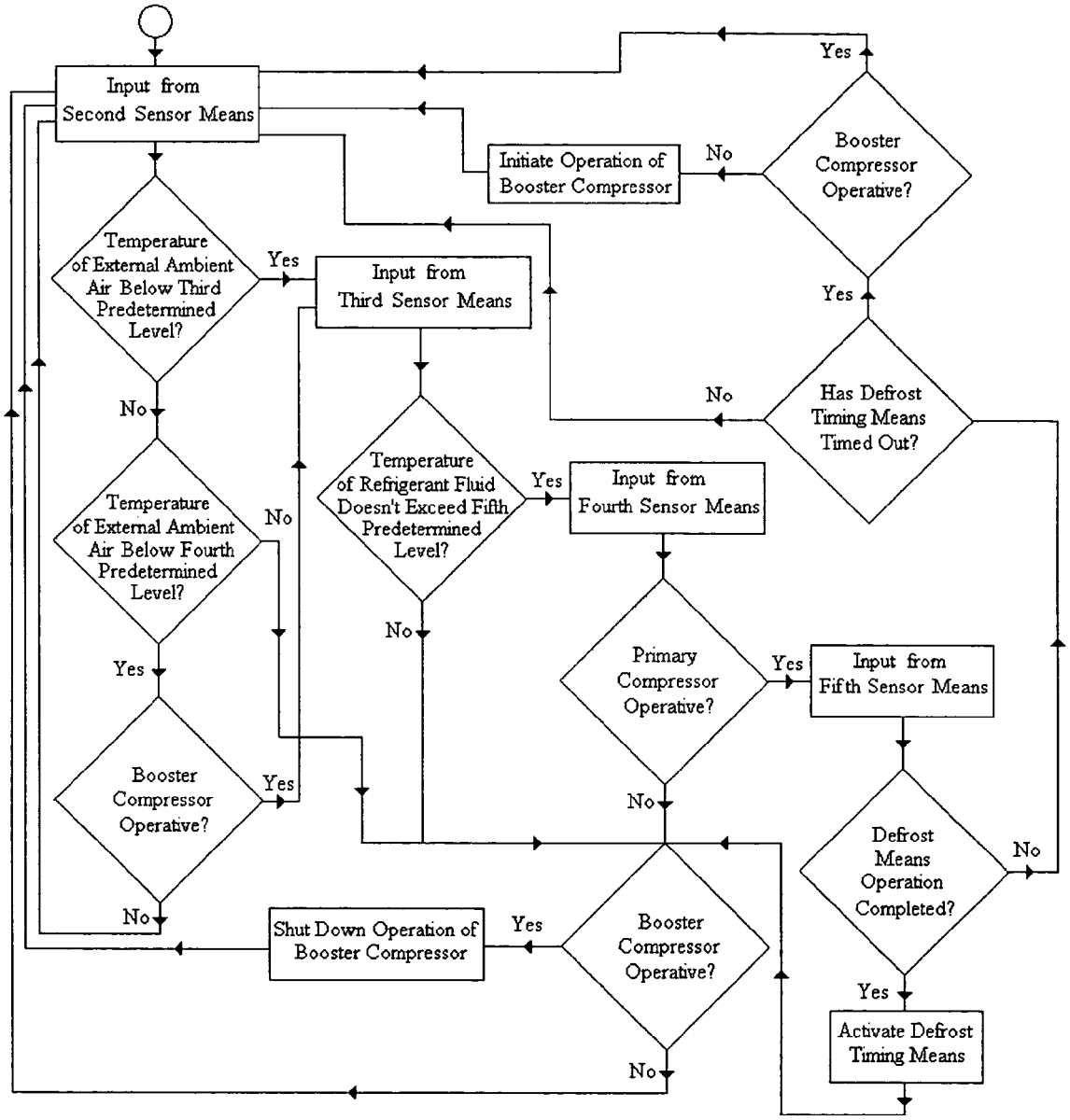
FIG. 6 is a flow chart demonstrating the operation of the logic controller with an optional defrost timing means used in conjunction with the fifth sensor means.

In one embodiment the air-source heat pump is provided with a reversing valve 92 allowing the air-source heat pump to operate in a cooling mode as well as in a heating mode. In this embodiment the heat pump further includes at least one additional expansion device and check valves 106 in a configuration well known in the art. FIG. 2 is a schematic drawing of the interrelationship of components with the reversing valve 92 positioned to allow the air-source heat pump to operate in a heating mode, and FIG. 3 is a schematic drawing of the interrelationship of components with the reversing valve 92 positioned to allow the air-source heat pump to operate in a cooling mode. The reversing valve 92 is in fluid communication with the primary compressor outlet 14, and can be moved between two positions. In the first position (for heating) the primary compressor outlet 14 is directed to the heat exchanger associated with the indoor environment. In the second position (for cooling), the primary compressor outlet 14 is directed to the heat exchanger associated with the outdoor environment. When the reversing valve 92 is in the first position, the refrigerant fluid flows through the flow conduit means 70 as described above, and the first heat exchanger 30 acts as a condenser and the second heat exchanger 40 acts as an evaporator. When the reversing valve 92 is in the second position, the primary compressor outlet 14, the second heat exchanger 40, the expansion device 50, the first heat exchanger 30, the booster compressor inlet 22, the booster compressor outlet 24, and the primary compressor inlet 12 are placed in respective serial fluid communication to circulate the refrigerant fluid through the air-source heat pump in the opposite direction as when the reversing valve 92 is in the first position. In this configuration, the second heat exchanger 40 acts as a condenser and the first heat exchanger 30 (located inside the interior space) acts as an evaporator. The evaporation of the refrigerant fluid in the first heat exchanger 30 draws heat energy out of the ambient air of the interior space, cooling that space. Similarly, the condensing of the refrigerant fluid in the second heat exchanger 40 releases heat energy into the exterior ambient air. This configuration is well known in the art.

In one embodiment of the present invention the air-source heat pump uses the above-described ability of the system to operate in a cooling mode to defrost the second heat exchanger. As described, when the system operates in a cooling mode, the condensing of the refrigerant fluid in the second heat exchanger 40 releases heat energy, which serves to melt any built up ice from the second heat exchanger 40. In another embodiment the air-source heat pump uses external heat sources to defrost the second heat exchanger, such as a gas furnace.

The present invention further provides for an improved defrost cycle controller to increase the safety of the system. The defrost solutions known in the art—reversing the flow of refrigerant fluid within the system, heating the evaporator coils with external heat sources—result in elevating the temperature of the refrigerant fluid to potentially unsafe levels. In this embodiment the air-source heat pump incorporates a timing delay in the defrost cycle to allow the refrigerant fluid to cool to safe levels. The air-source heat pump comprises a defrosting means and a fifth sensor means which senses operation of the defrosting means, and the booster compressor operation control means 26 comprises a defrost timing means. The fifth sensor means signals the booster compressor operation control means 26 that the defrosting means had completed a defrosting cycle, whereupon the booster compressor operation control means 26 activates the defrost timing means and shuts down operation of the booster compressor 20. Upon a predetermined period of time elapsing, as determined by the defrost timing means, the booster compressor operation control means 26 re-initiates operation of the booster compressor 20. This embodiment may also incorporate the logic controller and/or the first timing means as described above to determine proper initiation and shut down of operation of the booster compressor 20.

The addition of a means for controlling operation of the booster compressor 20 based on the defrost cycle is yet another important safety feature of the present invention and an improvement over the prior art. If operation of the booster compressor 20 is initiated (or allowed to continue) at the end of a defrost cycle that allows the evaporator coil of the second heat exchanger 40 to overheat, the temperature of the refrigerant fluid discharged from the booster compressor 20 may be above the operational range of the primary compressor 10. This could cause the primary compressor 10 to overheat, and over time become damaged. Under such circumstances, the logic controller will prevent operation of the booster compressor 20 for a period of time, which will allow the refrigerant fluid to be cooled by the ordinary operation of the primary compressor 10.

Modifications and variations can be made to the disclosed embodiments of the invention without departing from the subject or spirit of the invention as defined in the following claims.

I claim:

1. An air-source heat pump comprising:

a primary compressor having a primary compressor inlet and a primary compressor outlet;

a booster compressor having a booster compressor inlet and a booster compressor outlet;

a first heat exchanger;

a second heat exchanger;

an expansion device;

a refrigerant fluid;

a flow conduit means connecting the first and second heat exchangers, the primary and booster compressors, and the expansion device for circulating the refrigerant fluid in a closed loop, whereby the primary compressor outlet, the first heat exchanger, the expansion device, the second heat exchanger, the booster compressor inlet, the booster compressor outlet, and the primary compressor inlet are placed in respective serial fluid communication with one another to thereby circulate the refrigerant fluid, and the flow conduit means is further connected to bypass the booster compressor and deliver refrigerant fluid from the second heat exchanger to the primary compressor when the booster compressor is inoperative, and with the flow conduit means connected to deliver refrigerant fluid from the second heat exchanger to the booster compressor and from the booster compressor to the primary compressor when operation of the booster compressor is initiated;

a first sensor means for sensing the temperature of internal ambient air;

a second sensor means for sensing the temperature of external ambient air;

a third sensor means for sensing the temperature of the refrigerant flowing between the booster compressor outlet and the primary compressor inlet;

a fourth sensor means for sensing the operation of the primary compressor;

a primary compressor operation control means responsive to inputs from the first sensor means, in connection with the primary compressor and in connection with the first sensor means, wherein the primary compressor operation control means initiates operation of the primary compressor when the first sensor means indicates the temperature of the ambient air is below a first predetermined level, and the primary compressor operation control means shuts down operation of the primary compressor when the first sensor means indicates the temperature of the ambient air has achieved a second predetermined level; and a booster compressor operation control means responsive to inputs from the second, third, and fourth sensor means, in connection with the booster compressor and in connection with the second, third, and fourth sensor means, wherein the booster compressor operation control means initiates operation of the booster compressor when the second sensor means indicates the temperature of the external ambient air is below a third predetermined level whereby operation of the primary compressor alone is not efficient, the booster compressor operation control means shuts down operation of the booster compressor when the second sensor means indicates the temperature of the external ambient air has achieved a fourth predetermined level whereby the primary compressor may be efficiently operated alone, the booster compressor operation control means shuts down operation of the booster compressor when the third sensor means indicates the temperature of the refrigerant fluid flowing between the booster compressor outlet and the primary compressor inlet exceeds a fifth predetermined level, and the booster compressor operation control means shuts down operation of the booster compressor when the fourth sensor means indicates the primary compressor is inoperative.

2. The air-source heat pump of claim 1 wherein one of the first and second heat exchange means is an evaporator; and the other of the first and second heat exchange means is a condenser.

3. The air-source heat pump of claim 1 further comprising a reversing valve, in fluid communication through the flow conduit means with the primary compressor outlet, said reversing valve capable of being movably positioned between a first position and a second position, to control the direction of flow of the refrigerant fluid through in the flow conduit means, wherein when the reversing valve is positioned in the first position refrigerant fluid is directed from the primary compressor outlet to one of the heat exchangers, and when the reversing valve is positioned in the second position refrigerant fluid is directed from the primary compressor outlet to the other of the heat exchangers.

4. The air-source heat pump of claim 1 wherein the refrigerant fluid is R410A.

5. The air-source heat pump of claim 1 wherein the expansion device is a thermal expansion valve.

6. The air-source heat pump of claim 1 wherein the first sensor means comprises an electronic temperature sensing device.

7. The air-source heat pump of claim 1 wherein the second sensor means comprises an electronic temperature sensing device.

8. The air-source heat pump of claim 1 wherein the third sensor means comprises an electronic temperature sensing device.

9. The air-source heat pump of claim 1 wherein the fourth sensor means comprises a current transformer, with the fourth sensor means generating an input to the booster compressor operation control means indicating the primary compressor is operative when current flowing to the primary compressor falls within a predetermined range, and the fourth sensor means generating an input to the booster compressor operation control means indicating the primary compressor is inoperative when current flowing to the primary compressor falls outside the predetermined range.

10. The air-source heat pump of claim 1 wherein the fourth sensor means comprises a centrifugal switch, said centrifugal switch being in connection with a motor of the primary compressor and configured to close when the motor is turning and to open when the motor is not turning, with the fourth sensor means generating an input to the booster compressor operation control means indicating the primary compressor is operative when the centrifugal switch is closed, and the fourth sensor means generating an input to the booster compressor operation control means indicating the primary compressor is inoperative when the centrifugal switch is opened.

11. The air-source heat pump of claim 1 wherein the fourth sensor means comprises a flow switch, said flow switch located in the primary compressor outlet and configured to close when the flow of the refrigerant fluid from the primary compressor outlet falls within a predetermined range and to open when the flow of the refrigerant fluid from the primary compressor outlet falls outside the predetermined range, with the fourth sensor means generating an input to the booster compressor operation control means indicating the primary compressor is operative when the flow switch is closed, and the fourth sensor means generating an input to the booster compressor operation control means indicating the primary compressor is inoperative when the flow switch is opened.

12. The air-source heat pump of claim 1 wherein the booster compressor operation control means comprises a logic controller, whereby the logic controller evaluates inputs from the second, third, and fourth sensor means to determine when operation of the booster compressor should be initiated and when operation of the booster compressor should be shut down, with the booster compressor operation control means configured to initiate operation of the booster compressor when the second sensor means indicates the temperature of the external ambient air is below a third predetermined level, the third sensor means indicates the temperature of the refrigerant fluid flowing between the booster compressor outlet and the primary compressor inlet does not exceed a fifth predetermined level, and the fourth sensor means indicates the primary compressor is operative, and the booster compressor operation control means configured to shut down operation of the booster compressor when the second sensor means indicates the temperature of the external ambient air exceeds a fourth predetermined level and/or the third sensor means indicates the temperature of the refrigerant fluid flowing between the booster compressor outlet and the primary compressor inlet exceeds a fifth predetermined level and/or the fourth sensor means indicates the primary compressor is inoperative.

13. The air-source heat pump of claim 12 wherein the booster compressor operation control means further comprises a first timing means, whereby the first timing means is activated upon the booster compressor operation control means shutting down operation of the booster compressor as a result of the third sensor means indicating the temperature of the refrigerant fluid flowing between the booster compressor outlet and the primary compressor inlet exceeds a fifth predetermined level, and thereafter the logic controller evaluates the first timing means and evaluates inputs from the second, third, and fourth sensor means, to determine when operation of the booster compressor should be re-initiated, with the booster compressor operation control means re-initiating operation of the booster compressor when inputs received by the booster compressor operation control means from the second, third, and fourth sensor means are determined by the logic controller to indicate proper conditions for operation of the booster compressor and a predetermined period of time has elapsed as determined by the first timing means.

14. The air-source heat pump of claim 1 wherein the first heat exchanger is a condenser located in the flow conduit means downstream of the primary compressor and upstream of the expansion device; and the second heat exchanger is an evaporator located in the flow conduit means downstream of the expansion device and upstream of the booster compressor.

15. The air-source heat pump of claim 14 further comprising a defrosting means sufficient to eliminate ice buildup from the second heat exchanger.

16. The air-source heat pump of claim 15 further comprising a fifth sensor means for sensing operation of the defrosting means, with the fifth sensor means in connection with the booster compressor operation control means and the booster compressor operation control means responsive to inputs from the fifth sensor means; and the booster compressor operation control means comprises a defrost timing means;

whereby the booster compressor operation control means shuts down operation of the booster compressor and activates the defrost timing means upon receiving an input from the fifth sensor means indicating the defrosting means had completed a defrosting cycle, and the booster compressor operation control means re-initiates operation of the booster compressor when a first predetermined period of time has elapsed as determined by the defrost timing means.

17. The air-source heat pump of claim 16 wherein the booster compressor operation control means further comprises a logic controller, whereby the logic controller evaluates inputs from the second, third, fourth, and fifth sensor means and the defrost timing means to determine when operation of the booster compressor should be initiated and when operation of the booster compressor should be shut down, with the booster compressor operation control means configured to initiate operation of the booster compressor when the second sensor means indicates the temperature of the external ambient air is below a third predetermined level, the third sensor means indicates the temperature of the refrigerant fluid flowing between the booster compressor outlet and the primary compressor inlet does not exceed a fifth predetermined level, the fourth sensor means indicates the primary compressor is operative, and the defrost timing means indicates more than the first predetermined period of time has elapsed since the defrosting means last completed a defrosting cycle, and the booster compressor operation control means configured to shut down operation of the booster compressor when the second sensor means indicates the temperature of the external ambient air has achieved a fourth predetermined level and/or the third sensor means indicates the temperature of the refrigerant fluid flowing between the booster compressor outlet and the primary compressor inlet exceeds a fifth predetermined level and/or the fourth sensor means indicates the primary compressor is inoperative and/ or the fifth sensor means indicates the defrosting means has completed a defrosting cycle and the first predetermined period of time as determined by the defrost timing means has not yet elapsed.

18. The air-source heat pump of claim 17 wherein the booster compressor operation control means further comprises a second timing means, whereby the second timing means is activated upon the booster compressor operation control means shutting down operation of the booster compressor as a result of the third sensor means indicating the temperature of the refrigerant fluid flowing between the booster compressor outlet and the primary compressor inlet exceeds a fifth predetermined level, and thereafter the logic controller evaluates the second timing means and evaluates inputs from the second, third, fourth, and fifth sensor means and the defrost timing means, to determine when operation of the booster compressor should be re-initiated, with the booster compressor operation control means re-initiating operation of the booster compressor when inputs received by the booster compressor operation control means from the second, third, fourth, and fifth sensor means and from the defrost timing means are determined by the logic controller to indicate proper conditions for operation of the booster compressor, and a second predetermined period of time has elapsed as determined by the second timing means.

19. The air-source heat pump of claim 15 further comprising a reversing valve, in fluid communication through the flow conduit means with the primary compressor outlet, said reversing valve capable of being movably positioned between a first position and a second position, to control the direction of flow of the refrigerant fluid through in the flow conduit means, wherein when the reversing valve is positioned in the first position refrigerant fluid is directed from the primary compressor outlet to the first heat exchanger, and when the reversing valve is positioned in the second position refrigerant fluid is directed from the primary compressor outlet to the second heat exchanger.

* * * * *